US006069310A

United States Patent [19]

James

[11] Patent Number: 6,069,310

[45] Date of Patent: May 30, 2000

[54] METHOD OF CONTROLLING REMOTE EQUIPMENT OVER THE INTERNET AND A METHOD OF SUBSCRIBING TO A SUBSCRIPTION SERVICE FOR CONTROLLING REMOTE EQUIPMENT OVER THE INTERNET

[75] Inventor: William Charles James, Vienna, Va.

[73] Assignee: PRC Inc., McLean, Va.

[21] Appl. No.: 09/038,232

[22] Filed: Mar. 11, 1998

[51] Int. Cl.[7] ..... G10H 7/00

[52] U.S. Cl. ..... 84/645; 84/622

[58] Field of Search ..... 84/601–607, 622–625, 84/645, 659–660

[56] References Cited

U.S. PATENT DOCUMENTS

| | | | |
|---|---|---|---|
| 5,734,119 | 3/1998 | France et al. | 84/622 |
| 5,827,989 | 10/1998 | Fay et al. | 84/645 |

OTHER PUBLICATIONS

"Is Pay–per–Play the Wave of the Future", pp. 1–2, Jun. 25, 1997.

"Aldabra Pay–Per–View" pp. 1–2.

Player Systems "PDS–128 Plus with Silent Drive", Production Information, pianodisc.com/pds 128info.html, pp. 1–4.

SMF Format Converters "Standard MIDI File Format Converters", pianodisc.com/convert.html, 2 pages.

MSR/Piano Disc Products, Featured MSR/PianoDisc Products, "Pianos, Piano Players, Quiet Pianos and More", pianodisc.com/prodcts.html, 2 pages.

*Primary Examiner*—Robert E. Nappi

*Assistant Examiner*—Marlon Fletcher

*Attorney, Agent, or Firm*—Lowe Hauptman Gopstein Gilman & Berner

[57] ABSTRACT

A method is disclosed for transmitting musical performances over the Internet from a single point such as a piano Internet web site to multipoint such as player pianos located within subscriber's homes. A subscription service associated with the web site would offer monthly subscription services where a subscriber can access any one of millions of prerecorded performances at any time of day and have a signal transmitted to the subscriber's computer. A transmitted signal is received at the subscriber's computer and a musical instrument, such as a player piano, can perform the prerecorded performance. The web site would also offer a mix of live performances as part of the basic subscription at additional cost, at a pay-per-performance basis. The musical performance would be either a live performance which would be transmitted from point to multipoint or prerecorded performance which would be more typically sent from a storage device associated with the web site directly to a single customer.

23 Claims, 7 Drawing Sheets

METHOD OF CONTROLLING REMOTE EQUIPMENT OVER THE INTERNET AND A METHOD OF SUBSCRIBING TO A SUBSCRIPTION SERVICE FOR CONTROLLING REMOTE EQUIPMENT OVER THE INTERNET

TECHNICAL FIELD

The present invention relates generally to communications over the Internet and more particularly to transmission of a control signal over the Internet for controlling machines associated with receiving computers, and even more particularly to sending a signal representative of a musical performance over the Internet to receiving computers for causing a musical instrument, such as a player piano, to perform the musical performance.

BACKGROUND ART

Electronic player pianos are controlled based on signals from floppy disks and CD ROMs using known digital playing devices. However, the selection of available performances on floppy disks and CD ROMs for controlling a player piano is limited. Significantly, there is no way to have live performances played on a player piano from remote locations.

Live musical performances can be broadcast over the Internet and played on a personal computer using a "plug-in" such as crescendo by live update on the speakers associated with the computer. However, many prefer a simulation of the live performance by an instrument such as a player piano instead of being played on computer speakers.

Thus, there is a need in the art for a method for controlling musical instruments, such as player pianos, over the Internet. This would allow a live performance to be played on a player piano. This would also allow users, through a subscription service, to have access to unlimited numbers of prerecorded performances associated with a web site and which can be selected by a subscriber. Advantageously, the prerecorded performances would be available twenty-four hours a day, seven days per week. A method of using such a service would be available on a subscription basis in which any live performance in the world could be offered to the public on a pay-per-performance basis and also a subscription service would be available for the prerecorded performances.

DISCLOSURE OF THE INVENTION

It is, therefore, an object of the present invention to provide a method for transmitting musical performances over the Internet from a single point such as a piano Internet web site to multipoints such as player pianos located within subscribers' homes. A subscription service associated with the web site would offer monthly subscriptions services where a subscriber can access any one of millions of prerecorded performances at any time of day and have a signal transmitted to the subscriber's computer. The transmitted signal is received at the subscriber's computer and a musical instrument, such as a player piano can perform the prerecorded performance. The web site would also offer a mix of live performances as part of the basic subscription at additional cost, on a pay-per-performance basis. The musical performance would be either a live performance which would be transmitted from point to multipoint or a prerecorded performance which would be more typically sent from a storage device associated with the web site directly to a single customer. In either event, the signal from the storage device associated with the web site would be received by a computer at the subscriber's location and then resent from the computer located at the subscriber's location to a device external to the computer, such as a player piano.

In a broader aspect of the invention, it is envisioned that any type of electronically controllable equipment could be controlled over the Internet based upon control signals. These devices might include numerically controlled machines such as lathes and milling machines for demonstrations or for making reproductions, radio controlled model aircraft and many other types of equipment.

These and other objects of the present invention are provided by a method including transmitting a signal representative of a musical performance over a computer network from a source system to specified addresses. The transmitted signal representative of the musical performance are received at a plurality of receiving computers having the specified addresses. A musical instrument associated with one of the plurality of receiving computers is caused to perform the musical performance based on the received signal.

These and other objects of the present invention are also achieved by a method including transmitting a control signal over a computer network from a source system to specified addresses. The transmitted control signal is received at a plurality of receiving computers having the specified addresses. An electronically controlled machine associated with one of the plurality of receiving computers is caused to perform based on instructions included in the received signal.

These and other objects of the present invention are also achieved by a method including receiving a subscription request for a particular Internet address. A signal representative of a musical performance is sent over a computer network from a source system to the particular address. The signal representative of the musical performance is received at a receiving computer having the particular address. A musical instrument associated with a receiving computer is caused to perform the musical performance based on the received signal.

These and other objects of the present invention are also achieved by a computer implemented system for subscribing to a pay-per-performance service from an Internet web site and for transmitting each requested pay-per-performance over the Internet. The system includessubscriber account data file means for storing current information characterizing each pay-per-performance subscriber. Requesting means are provided for requesting a pay-per-performance. Verifying means are responsive to said subscriber account data file means for verifying that each requested pay-per-performance would be sent to a subscriber having a subscriber account in good standing. Transmitting means are provided for sending the pay-per-performance to the verified subscriber at a particular Internet protocol address.

Additional objects, advantages and novel features of the present invention will be set forth in part in the detailed description which follows, and in part will become apparent upon examination or may be learned by practice of the invention. The objects and advantages of the invention may be realized and obtained by means of the instrumentalities and combinations particularly pointed out in the appended claims.

BRIEF DESCRIPTION OF DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

A method and apparatus for controlling of a piece of equipment, such as a player piano is described. In the following description, for purposes of explanation, numerous specific details are set forth in order to provide a thorough understanding of the present invention. It will be apparent, however, that the present invention may be practiced without these specific details. In other instances, well known structures and devices are shown in block diagram form in order to avoid unnecessarily obscuring the present invention.

Network Overview

Figure 1:
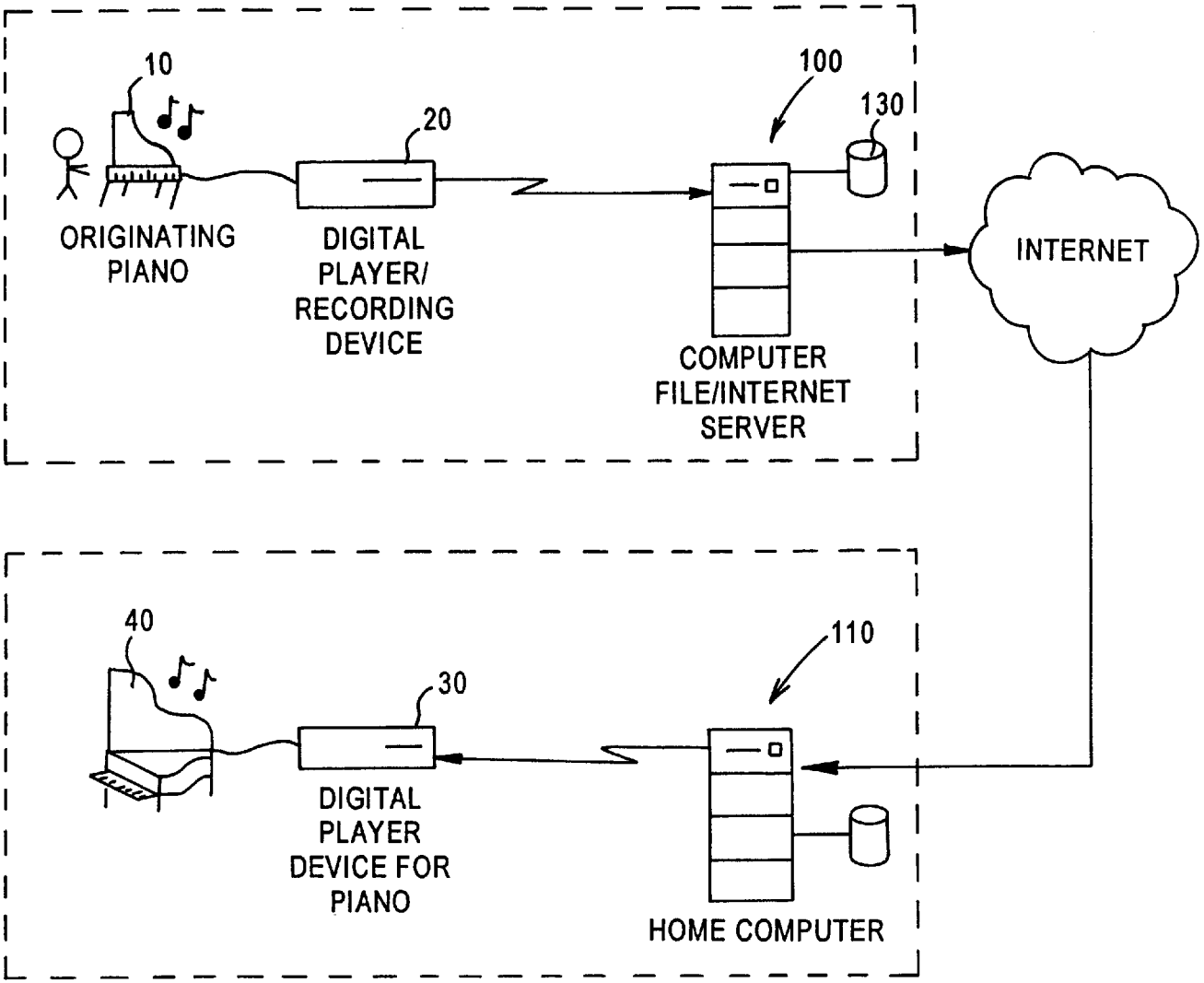
FIG. 1 is a high-level block diagram of the computer network with which the present invention could be implemented for a single receiving computer.

FIG. 1 is a schematic block diagram of a network 200 within which the present invention may be implemented. The network 200 includes an originating electronic player piano 10 which is connected to a digital player recording system 20. The recording system 20 is a digital player/recording device such as a commercially available PDS-128+ available from Knabe/Piano Disc. This type of recording system uses touch film technology for sensing velocity of the 88 keys on the keyboard of the player piano 10. The keyboard is scanned every 1.4 mm secs. The digital player/recording device 20 converts the sensed key strokes on the originating player piano 10 into a Musical Instrument Digital Interface (MIDI) data. The recording system 20 has an output port which outputs MIDI files or data. A computer file/Internet server 100 includes a storage device 130 and recording system 20 can output MIDI data to computer file 100 for storage in a storage device 130. As will be explained in detail below, computer file/Internet server 100 is connected to the Internet and can send MIDI files or data over the Internet.

A computer depicted as reference numeral 110 in FIG. 1 is also connected to the Internet and is capable of receiving MIDI files or data. Computer 110 may be similar in all respects to computer 100. Computer 110 transmits the received MIDI file or data to a digital player device 30 for piano such as the aforementioned PDS-128+. The computer 110 does not alter the received MIDI file or data in any manner but the received MIDI file or data merely passes through the computer 110. The digital player device for piano 30 has an external playback mode which allows MIDI data to be passed through device 30 to an external MIDI device such as a keyboard, sequencer, etc., for controlling a player piano 40 at a subscriber's location.

Figure 2:
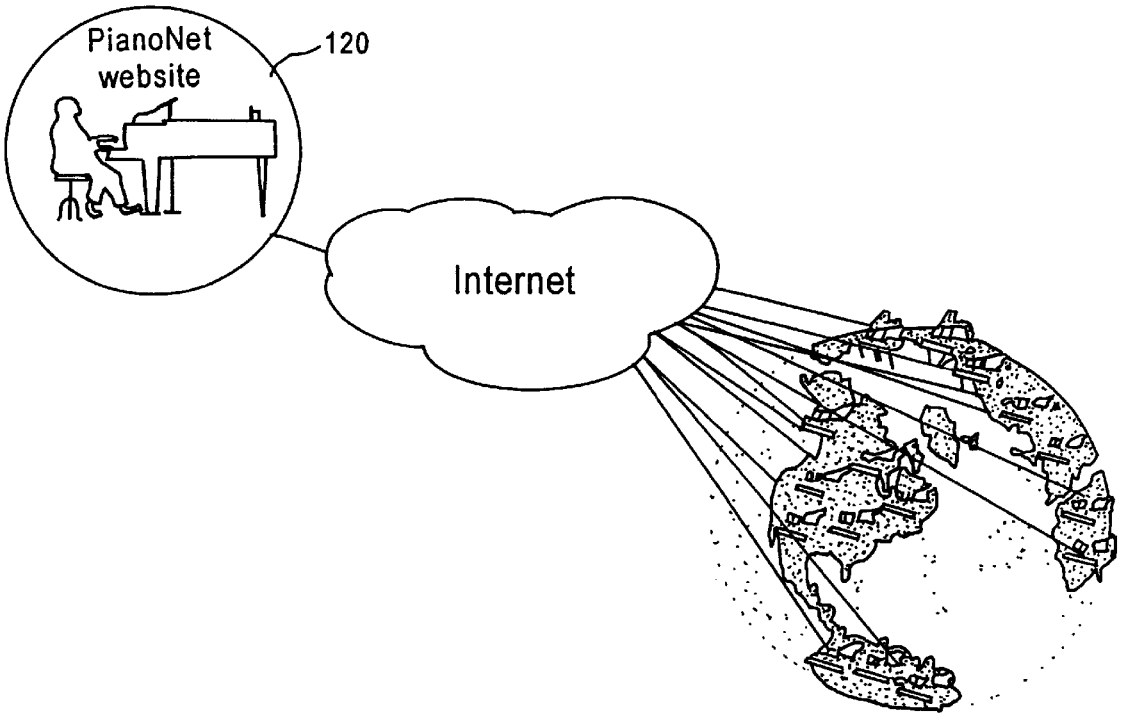
FIG. 2 is a high-level schematic diagram of a computer network in which the present invention could be implemented for a plurality of receiving computers.

Referring now to FIG. 2, another high-level schematic diagram is depicted having a piano Internet web site 120 which would be associated with the originating player piano 10, the digital player/recording device 20 and the computer file/Internet server 100 and storage device 130 which is connected to the Internet. FIG. 2 differs from FIG. 1 in that instead of just transmitting a musical performance to one computer which is associated with one player piano 40 over the Internet, in FIG. 2, the musical performance is transmitted to a plurality of computers 110 which is each associated with one player piano 40. The embodiment depicted in FIG. 2 is particularly advantageous for the transmission of live performances being played on a player piano to be transmitted to particular addresses on the Internet at which subscribers to a web site reside for the near live performance for a musical performance such as a piano recital and sending the live musical performance to a single subscriber.

Hardware Overview

Figure 3:
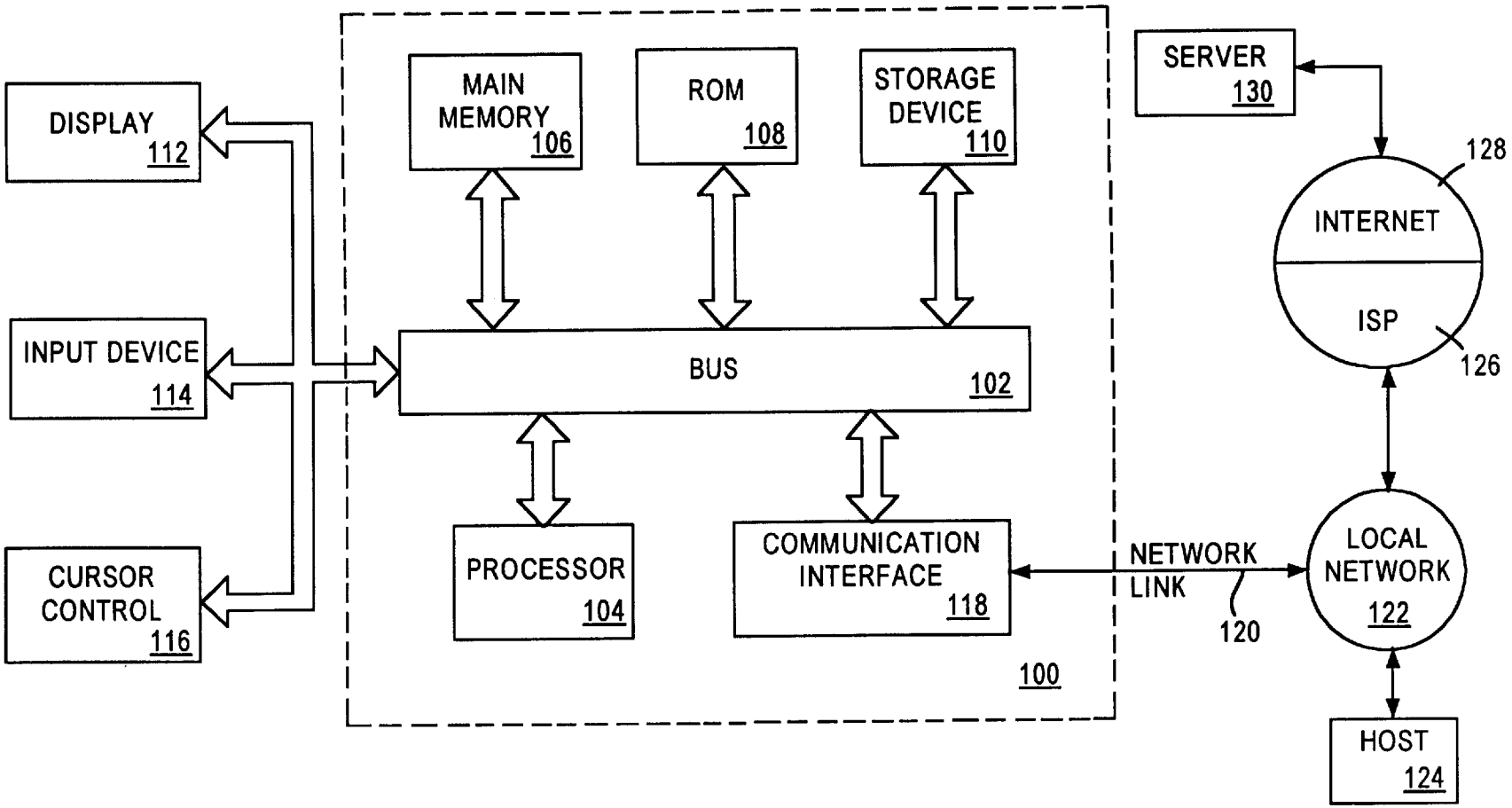
FIG. 3 is a block diagram of a computer system with which the present invention could be implemented.

FIG. 3 is a block diagram which illustrates a computer system 100 upon which an embodiment of the invention may be implemented. The computer system 100 is a typical workstation or personal computer (PC), although other computer platforms may be used. Computer system 100 includes a bus 102 or other communication mechanism for communicating information in two directions, and a processor 104 coupled with bus 102 for processing information. Computer system 100 also includes a main memory 106, such as a random access memory (RAM) or other dynamic storage device, coupled to bus 102 for storing information and instructions to be executed by process or 104. Main memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT), for displaying information to a computer user. An input device 114, including alphanumeric and other keys, is coupled to bus 102 for communicating information and command selections to processor 104. Another type of user input device is cursor control 116, such as a mouse, a trackball, or cursor direction keys for communicating direction information and command selections to processor 104 and for controlling cursor movement on display 112. This input device typically has two degrees of freedom in two axes, a first axis (e.g., x) and a second axis (e.g., y), which allows the device to specify positions in a plane.

An operating system program allows the processor 104 to respond to signals from the input device 114 and produce signals through a display driver to effectuate a desired user interface. For example, a computer running a Windows type operating system provides a graphical user interface, for the operating system functions as well as for applications running on the operating system. The operating system also enables the microprocessor to execute various other application programs.

The invention is related to the use of computer system 100 to receive and transmit MIDI files and data. According to one embodiment of the invention, receiving and transmitting MIDI files and data is provided by computer system 100 in response to processor 104 executing sequences of instructions contained in main memory 106. Such instructions may be read into main memory 106 from another computer-readable medium, such as storage device 110. However, the computer-readable medium is not limited to devices such as storage device 110. For example, the computer-readable medium may include a floppy disk, a flexible disk, hard disk, magnetic tape, or any other magnetic medium, a CD-ROM, any other optical medium, punch cards, paper tape, any other physical medium with patterns of holes, a RAM, a PROM, an EPROM, a FLASH-EPROM, any other memory chip or cartridge, a carrier wave embodied in an electrical, electromagnetic, infrared, or optical signal, or any other medium from which a computer can read. Execution of the sequences of instructions contained in main memory 106 causes processor 104 to perform the process steps previously described. In alternative embodiments, hardwired circuitry may be used in place of or in combination with software instructions to implement the invention. Thus, embodiments of the invention are not limited to any specific combination of hardware circuitry and software.

Computer system 100 also includes a communication interface 118 coupled to bus 102. Communication interface 108 provides a two-way data communication coupling to a network link 120 that is connected to a local network 122. For example, communication interface 118 may be an integrated services digital network (ISDN) card or a modem to provide a data communication connection to a corresponding type of telephone line. As another example, communication interface 118 may be a local area network (LAN) card to provide a data communication connection to a compatible LAN. Wireless links may also be implemented. In any such implementation, communication interface 118 sends and receives electrical, electromagnetic or optical signals which carry digital data streams in an appropriate format representing various types of information.

Network link 120 typically provides data communication through one or more networks to other data devices. For example, network link 120 may provide a connection through local network 122 to a host computer 124 or to data equipment operated by an Internet Service Provider (ISP) 126. ISP 126 in turn provides data communication services through the world wide packet data communication network now commonly referred to as the "Internet" 128. Local network 122 and Internet 128 both use electrical, electromagnetic or optical signals which carry digital data systems. The signals through the various networks and the signals on network link 120 and through communication interface 118, which carry the digital data to and from computer system 100, are exemplary forms of carrier waves transporting the information.

Computer system 100 can send messages and receive data, including program code, through the network(s), network link 120 and communication interface 118. In the Internet example, a server 130 might transmit a requested code for an application program through Internet 128, ISP 126, local network 122 and communication interface 118. In accordance with the invention, one such downloaded application provides for information discovery and visualization as described herein.

The received code may be executed by processor 104 as it is received, and/or stored in storage device 110, or other non-volatile storage for later execution. In this manner, computer system 100 may obtain application code in the form of a carrier wave.

The computer 100 can receive a new application via the modem or via an insertable storage media, such as a floppy or a tape or CD-ROM. When a new program is loaded, the processor 104 loads the received code from the drive or the modem, typically onto the hard disk storage. In this manner, the computer 100 may obtain application code in the form of a carrier wave, or the computer may obtain application code as data stored in a floppy disc, a compact disc or other transportable media. If the code represents an application program, the processor 104 later loads the code into random access main memory 106 for execution.

Thus, the program software, including any applications, may reside at different times on a variety of media, including the various memories, disk drives and other storage media. The computer platform 100 also may receive software in the form of carrier wave signals bearing digital code, via various communication ports and interfaces, such as the data interface(s) 118 and the modem.

Figure 4:
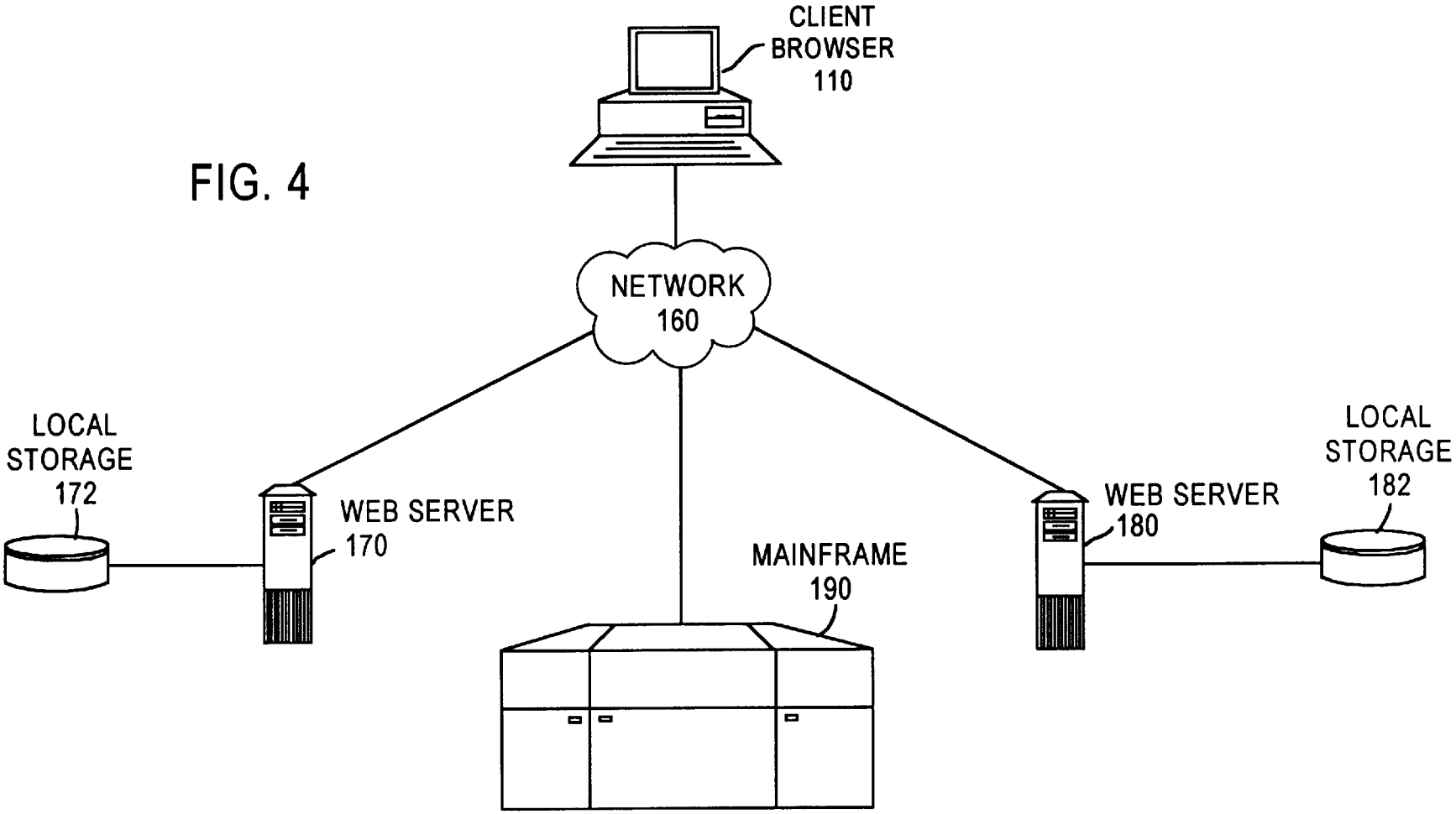
FIG. 4 is a diagram of a network in which the present invention could be implemented.

Referring to FIG. 4, depicted therein is a network 160 within which the present invention may be implemented. The web server 170 (this could also be computer 100) is accessible via the Internet by users operating a browser at computer 110. A user may access the web server 170 by executing a web browser at computer 110. Web browsers are well-known in the art, and are readily available from such corporations as Netscape Communications Corp. and Microsoft Corp. In order to access the web server 170, the user at client browser 110 activates a hyperlink having a URL (Uniform Resource Locator) of the following form:

Table 1 http://www.server.com

In the exemplary URL, the network address of the web server 170 is specified as "www.server.com" and the portion of the URL after .com can hold user specified parameters.

When a hyperlink is activated, the web server 170 receives a request to initiate a subscriber request to transmit a musical performance. In response, the web server 170 gathers MIDI files from one or more data sources. The data sources can be stored at a plurality of sites, for example, locally with respect to the web server 130, such as a hard disk at local storage 172, or externally at another site in the network, e.g, at mainframe 190. In fact, the data source can even be another, remote information discovery web server 180 having its own local storage 182. Alternatively, web server may access computer 100 to transmit a live performance to particular subscriber Internet protocol addresses. Thus, although subscribers access web site 170, the musical performance may be transmitted from a different device at a different Internet protocol address.

Figure 5:
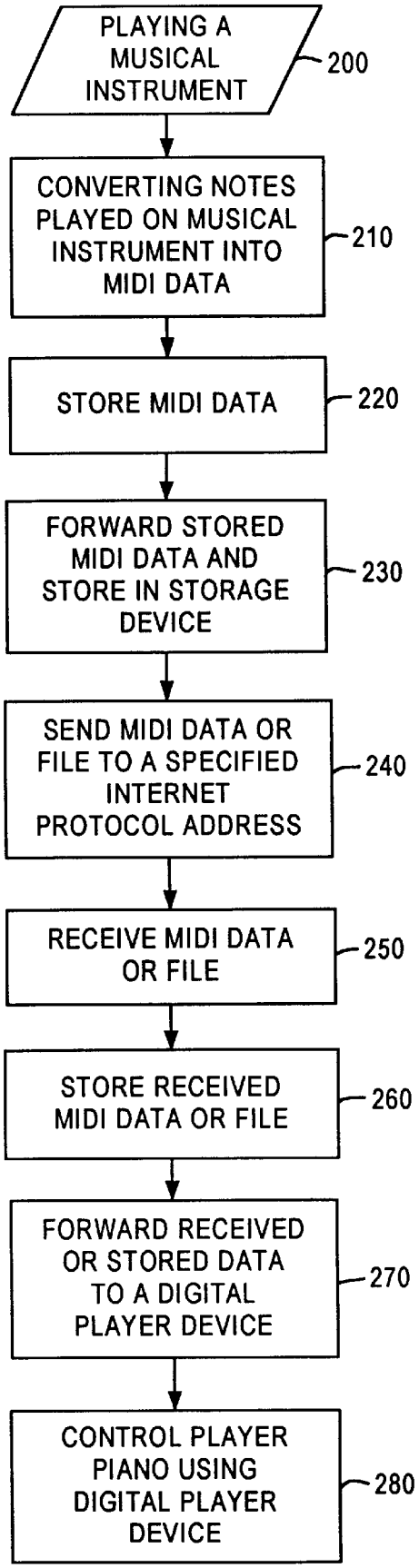
FIG. 5 is a flowchart illustrating an embodiment for transmitting a prerecorded musical performance from an internet server to one receiving computer.

Referring now to FIG. 5, at step 200, a musical instrument, such as a player piano, is played during a live performance. At step 210, the live musical performance is converted to a MIDI signal using a device such as the digital player/recording device 20. At step 220, this converted MIDI signal can be stored in the digital player/recording device 20. At step 230, the MIDI signal is forwarded from the digital player/recording device 20 to computer file 100 and can be stored in the storage device 130 of the computer file/Internet server 100. At step 240, computer file/Internet server 100 sends, over the Internet, a signal indicative of the musical performance to specified Internet protocol addresses which, as depicted in FIG. 1, would be the computer 110. At step 250, this sent MIDI signal is received by the computer 110 at the specified Internet protocol address. At step 260, the computer 110 may store the received MIDI data to account for time delays caused by a computer network such as the Internet. At step 270, computer 110 forwards the received MIDI signal to digital player device for piano 30. At step 280, the digital player device for piano 30 controls the playing of player piano 40 using the received MIDI signal.

Figure 6:
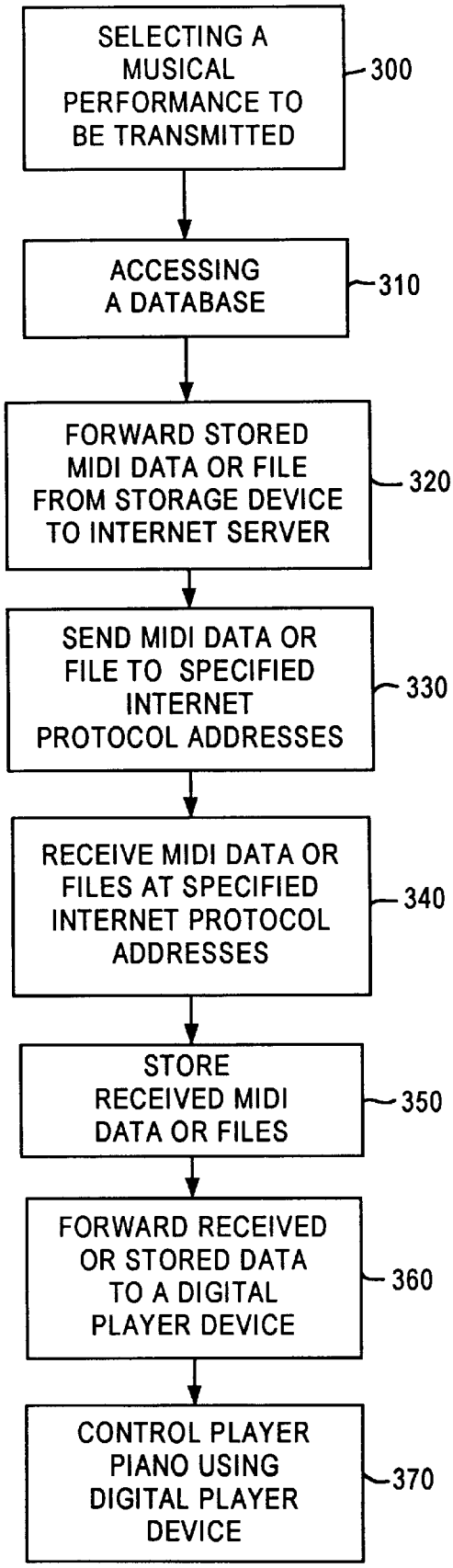
FIG. 6 is a flowchart illustrating an embodiment for transmitting a live musical performance from an Internet server to a plurality of receiving computers.

The FIG. 5 flowchart can be slightly modified so that a stored prerecorded musical performance can be sent to a single subscriber. At step 300 depicted in FIG. 6, a subscriber accesses a web site having an Internet server 130 and selects a stored prerecorded musical performance to be transmitted to a specified Internet protocol address, most likely the subscriber's address. At step 310, computer 110 accesses a data base of stored musical prerecorded events. At step 320, the prerecorded musical performance in MIDI file format that was accessed in step 310 is forwarded from the data base to the computer 110. At step 330, the accessed MIDI file is sent to the specified address of computer 110 over the Internet. At step 340, the MIDI data signal is received by the computer 110. At step 350, the received MIDI data signal may either be stored in whole or in part. At step 360, the received signal is forwarded from the computer 110 to the digital player for piano 30. At step 370, player piano 40 is played under control of digital player device for piano 30.

Figure 7:
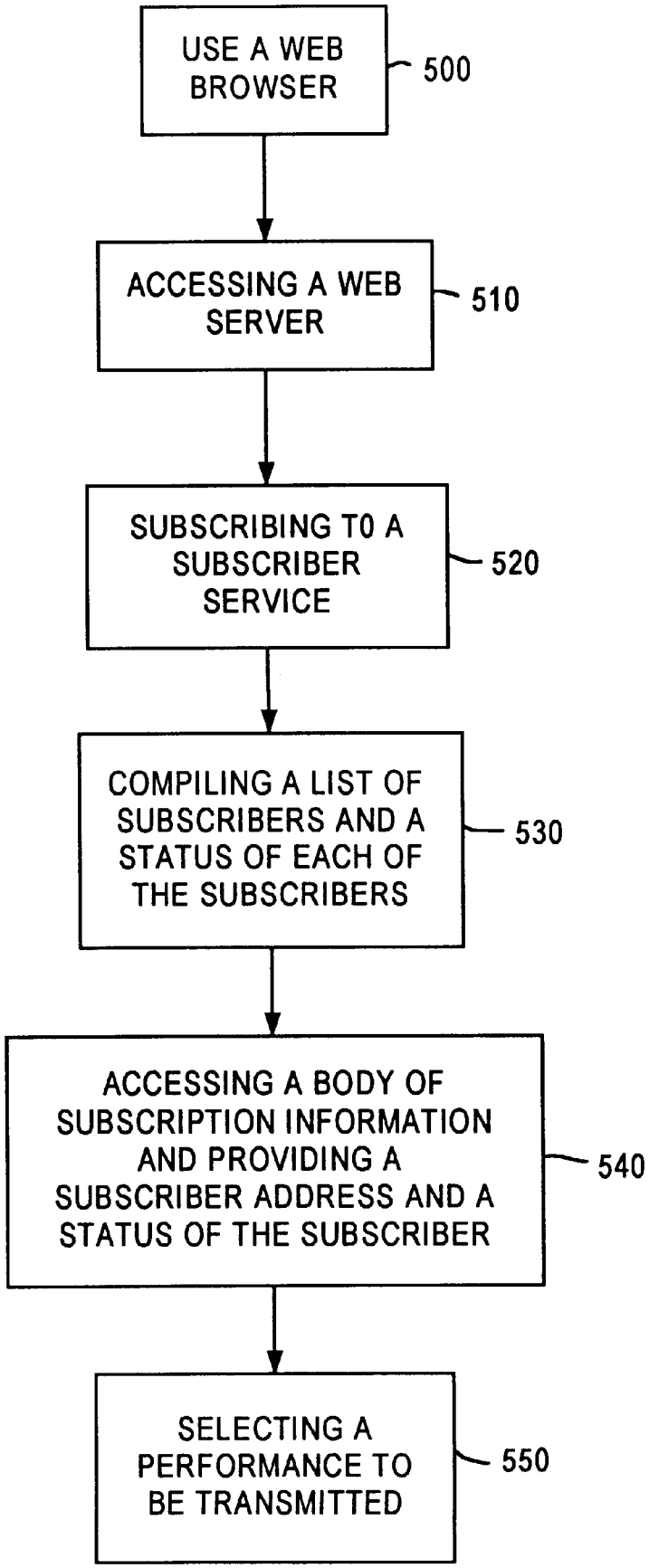
FIG. 7 is a flowchart illustrating an embodiment for subscribing to a web site to have musical performances transmitted over the Internet.

FIG. 7 is a flow chart of the process used in subscribing to the piano Internet subscription service and also for verifying that a user is a subscriber when the user accesses the web site.

A subscriber using a computer 110 having a web browser therein at step 510 accesses and web server at step 510. At step 520, the user subscribes to a subscriber service by entering various information, such as method of payment such as a credit card, an Internet protocol address, and a selection to be transmitted to the subscriber. At step 530, the server 130 compiles a list of subscribers and a status of each of the subscribers. At step 540, the server 130 accesses a body of subscription information and provides a subscriber address and a status of the subscriber. At step 550, server 130 selects a performance to be transmitted. If the status of the subscriber is acceptable, then after this step, the transmission of MIDI data or files will be the same as that depicted and described with respect to FIGS. 5 and 6.

It should now be readily apparent that a method of controlling remote equipment over the Internet and a method of subscribing to a subscription service for controlling remote equipment over the Internet has been described which is advantageous in that remote musical instruments or other electronically controlled equipment can be remotely controller over the Internet by a web server.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A method comprising:

transmitting a signal representative of a musical performance over a computer network from a source system to specified addresses;

receiving, at a plurality of receiving computers having the specified addresses, the transmitted signal representative of the live musical performance;

forwarding a received signal from one of the receiving computers to an external device which controls the musical instrument; and causing a musical instrument each associated with one of the plurality of receiving computers and under control of the external device to perform the musical performance using the received signal in real time.

2. The method of claim 1, wherein the musical instrument is a player piano.

3. The method of claim 1, wherein the computer network comprises the Internet.

4. The method of claim 1, comprising converting a live musical performance into digital data wherein the broadcast signal is the digital data.

5. The method of claim 1, wherein the receiving step is performed by plug-in receiver software.

6. The method of claim 1, wherein the external device includes a musical instrument digital interface file.

7. The method of claim 1, wherein each of the receiving computers includes a musical instrument digital interface file.

8. The method of claim 1, comprising storing received broadcast signals at one of the receiving computers sufficient to account for broadcast delays introduced by the computer network.

9. A computer implemented method, comprising:

receiving a subscription request for a particular address;

sending a signal representative of a live musical performance over a computer network from a source system to the particular address;

receiving the signal representative of the live musical performance at a receiving computer having the particular address;

forwarding a received signal from one of the receiving computers to an external device which controls the musical instrument; and causing a musical instrument associated with the receiving computer to perform the live musical performance using the received signal under control of the external device in real time.

10. The method of claim 9, wherein the musical instrument is a player piano.

11. The method of claim 9, wherein the computer network comprises the Internet.

12. The method of claim 9, comprising of converting a live musical performance into digital data wherein the broadcast signal is the digital data.

13. The method of claim 9, wherein the receiving step is performed by plug-in receiver software.

14. The method of claim 9, comprising forwarding a received signal from one of the receiving computers to an external device which controls the musical instrument.

15. The method of claim 14, wherein the external device includes a musical instrument digital interface file.

16. The method of claim 15, wherein each of the receiving computers includes a musical instrument digital interface file.

17. The method of claim 9, wherein the causing step is performed in near real time.

18. The method of claim 9, further comprising facilitating subscribing to a subscription service so that the web site will permit the selection of a performance.

19. The method of claim 9, comprising storing received signals at the receiving computer sufficient to account for transmission delays introduced by the computer network.

20. The method of claim 9, further comprising accessing a body of subscription information and determining a subscriber address and a status of the subscriber.

21. A computer system implemented method for subscribing to a pay-per-performance service from an Internet web site and for transmitting each requested pay-per-performance over the Internet, comprising:

subscriber account data file means for storing current information characterizing each pay-per-performance subscriber;

requesting means for requesting a pay-per-performance;

verifying means responsive to said subscriber account data file means for verifying that each requested pay-per-performance would be sent to a subscriber having a subscriber account in good standing;

transmitting means for sending the pay-per-performance to the verified subscriber at a particular Internet protocol address;

wherein the pay-per-performance is a live performance and the transmitting means transmits a signal representative of the live performance over a computer network from a source system to a specified address;

receiving means for receiving at a receiving computer having the specified address, the transmitted signal representative of the musical performance;

forwarding means for forwarding a received signal from the receiving computer to an external device which controls a musical instrument; and causing means for causing the musical instrument associated with the receiving computer under control of the external device to perform the musical performance using the received signal in real time.

22. The method of claim 1, wherein the external device is separate from the receiving computer.

23. The method of claim 1, wherein the external device is a MIDI controller.

* * * * *